US007631388B2

(12) United States Patent
Stark et al.

(10) Patent No.: US 7,631,388 B2
(45) Date of Patent: Dec. 15, 2009

(54) HAND-GUIDED SWEEPER

(75) Inventors: Thomas Stark, Waiblingen (DE); Jan Koalick, Waiblingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 871 days.

(21) Appl. No.: 11/206,190

(22) Filed: Aug. 18, 2005

(65) Prior Publication Data

US 2006/0048317 A1 Mar. 9, 2006

(30) Foreign Application Priority Data

Sep. 3, 2004 (DE) ..... 10 2004 042 708

(51) Int. Cl.
*E01H 1/02* (2006.01)
*A47L 11/24* (2006.01)

(52) U.S. Cl. ..... 15/79.2; 15/49.1

(58) Field of Classification Search ..... 15/49.1, 15/79.2, 98

See application file for complete search history.

(56) References Cited

U.S. PATENT DOCUMENTS

| | | | | | |
|---|---|---|---|---|---|
| 1,846,507 | A | * | 2/1932 | Boring | 56/10.3 |
| 2,765,483 | A | * | 10/1956 | Le Blanc | 15/79.2 |
| 3,086,789 | A | * | 4/1963 | Kleiman | 280/43 |
| 5,054,151 | A | * | 10/1991 | Estes, Sr. | 15/79.2 |
| 2005/0045347 | A1 | | 3/2005 | Stark et al. | |

* cited by examiner

*Primary Examiner*—Randall Chin
(74) *Attorney, Agent, or Firm*—Walter Ottesen

(57) ABSTRACT

A hand-guided sweeper (1) includes a guide rod (3) on which a handle (24) is mounted for guiding the sweeper (1) over the ground. The sweeper (1) has at least one sweeper brush (10), which is driven in rotation by a drive motor (2), and at least one wheel (5). The wheel (5) and the sweeper brush (10) lie against the ground during operation of the sweeper (1). The sweeper (1) has a first adjusting device (50) which permits an adjustment of the guide rod (3) relative to the sweeper brush (10) about a vertical axis (43) referred to the ground.

14 Claims, 2 Drawing Sheets

HAND-GUIDED SWEEPER

CROSS REFERENCE TO RELATED APPLICATION

This application claims priority of German patent application no. 10 2004 042 708.9, filed Sep. 3, 2004, the entire content of which is incorporated herein by reference.

BACKGROUND OF THE INVENTION

United States patent publication US 2005/0045347 A1 discloses a hand-guided work apparatus such as a sweeper. The work apparatus includes a guide rod for guiding the work apparatus over the ground and a work tool which is driven in rotation by a drive motor. Two wheels are provided for guiding the work apparatus over the ground. The wheels can be adjusted in order to make possible an adjustment in elevation. However, this causes the elevation of the handles of the work apparatus to change.

It has been shown that, for a sweeper, an inclination of the running direction of the sweeper brush relative to the running direction of the wheels is advantageous because, in this way, a dirtying of an already cleaned ground surface can be avoided. To make possible a back and forth cleaning of a surface, it is desirable that the inclination of the running direction of the sweeper brush be adjusted relative to the running direction of the wheels. The running direction is then the direction in which the wheel or the sweeper brush rolls on the ground, that is, the peripheral direction of wheel or sweeper brush perpendicular to the rotational axis in the region in contact with the ground. However, with an inclined sweeper brush, an adaptation of the handle elevation via an adjustment of the wheels is no longer possible because one end of the sweeper brush would lift up away from the ground.

SUMMARY OF THE INVENTION

It is an object of the invention to provide a hand-guided sweeper which permits an adaptation of the handle elevation and the running direction of the sweeper in a simple manner.

The hand-guided sweeper of the invention includes: a guide rod; at least one handle attached to the guide rod for guiding the sweeper over the ground; at least one sweeper brush; a drive motor for driving the sweeper brush in rotation; at least one wheel and the at least one wheel and the sweeper brush being in contact engagement with the ground during operation of the sweeper; and, an adjusting device for positionally adjusting the guide rod relative to the sweeper brush about an axis vertical with respect to the ground.

The sweeper brush is displaceable about an axis referred to the ground. In this way, it is ensured that the sweeper brush lies on the ground after the adjustment or displacement. An adjustment of the handles can be achieved advantageously in that the guide rod is adjusted about a horizontal axis. The position of the wheels and the brush remains the same so that the position of the sweeper brush on the ground is not influenced by the adjustment of the elevation of the handles.

It is practical to mount the first and second adjusting devices on a common connecting flange. In this way, it is especially possible to retrofit existing sweepers with little complexity with the adjusting devices. The complexity for the retrofit is slight because both adjusting devices are mounted on a common connecting flange.

Advantageously, the first adjusting device includes a pin which, in a first position of the adjusting device, is arranged in a first opening and, in a second position of the adjusting device, the pin is arranged in a second opening. In this way, a simple adjustability is provided. The openings define fixed adjusting positions so that the operator can undertake an adjustment to the desired position in a simple manner. Advantageously, the pin is held by a spring in the opening. For adjusting, the pin need only be moved against the force of the spring out of the one opening and moved to another opening where the pin automatically latches into place because of the force of the spring. The spring ensures also that the pin is held reliably in the opening. Advantageously, the first adjusting device has three openings which make possible an arrangement of the sweeper brush in three positions, namely: parallel to the running direction of the wheel, rotated in one direction by 15° relative to the running direction of the wheel and rotated in the other direction by 15° relative to the running direction of the wheel. It has been shown that dirt is swept only in one direction for a rotation of the sweeper brush by 15° relative to the running direction of the wheel so that an already cleaned surface does not become dirty again. When sweeping in the counter direction, the sweeper brush can be rotated in a simple manner by 15° relative to the running direction of the wheel in the opposite direction so that a dirtying of an already cleaned surface is avoided.

The first adjusting device is advantageously mounted on the end of the guide rod facing toward the sweeper brush. A rapid and ergonomic actuation of the adjusting device can be ensured in that the first adjusting device has an actuating element which extends up to the end of the guide rod facing away from the sweeper brush. The actuating element can then be reached by an operator standing in the region of the handles. The operator need not go to the other end of the guide rod. In this way, an ergonomic working by the operator and a rapid adjustment is possible. A simple and stable embodiment of the actuating element is obtained when the actuating element is configured as an actuating tube which is connected to the pin. The first adjusting device has a mounting flange which is attached to the connecting flange so as to be rotatable about the vertical axis and on which the actuating element is attached. Advantageously, the drive motor and the sweeper brush are connected to a common mount with a mounting flange. In this way, the adjusting devices can be retrofitted via a simple fixing of the mount to the mounting flange. In order to ensure an adequate stability of mounting flange and connecting flange, it is provided that the mounting flange and/or the connecting flange contain magnesium. According to a feature of the invention, the connecting flange and mounting flange are of magnesium.

Advantageously, the second adjusting device has toothed elements which are in engagement with each other. The first toothed element is advantageously connected to the connecting flange so that it cannot rotate relative thereto and the second toothed element is connected to the guide rod. The toothed elements are releasably clamped against each other. By loosening the tension or clamping force, the toothed elements can be rotated relative to each other so that the guide rod can be rotated relative to the connecting flange about a horizontal axis. A simple manipulation can be achieved in that the connecting flange is so pretensioned that the toothed elements can be rotated relative to each other when the clamping force is released. To adjust the guide rod, the clamping force need simply be relaxed or loosened and the guide rod can be rotated into the desired position. The guide rod is fixed by a renewed clamping of the toothed elements. With the configuration of the toothed elements, a good adjustability of the handle elevation is achieved with high stability and low weight of the adjusting device. Advantageously, the second adjusting device is configured to be mirror inverted to the center axis of the guide rod and has two pairs of toothed elements which are mounted on respective sides of the guide rod.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
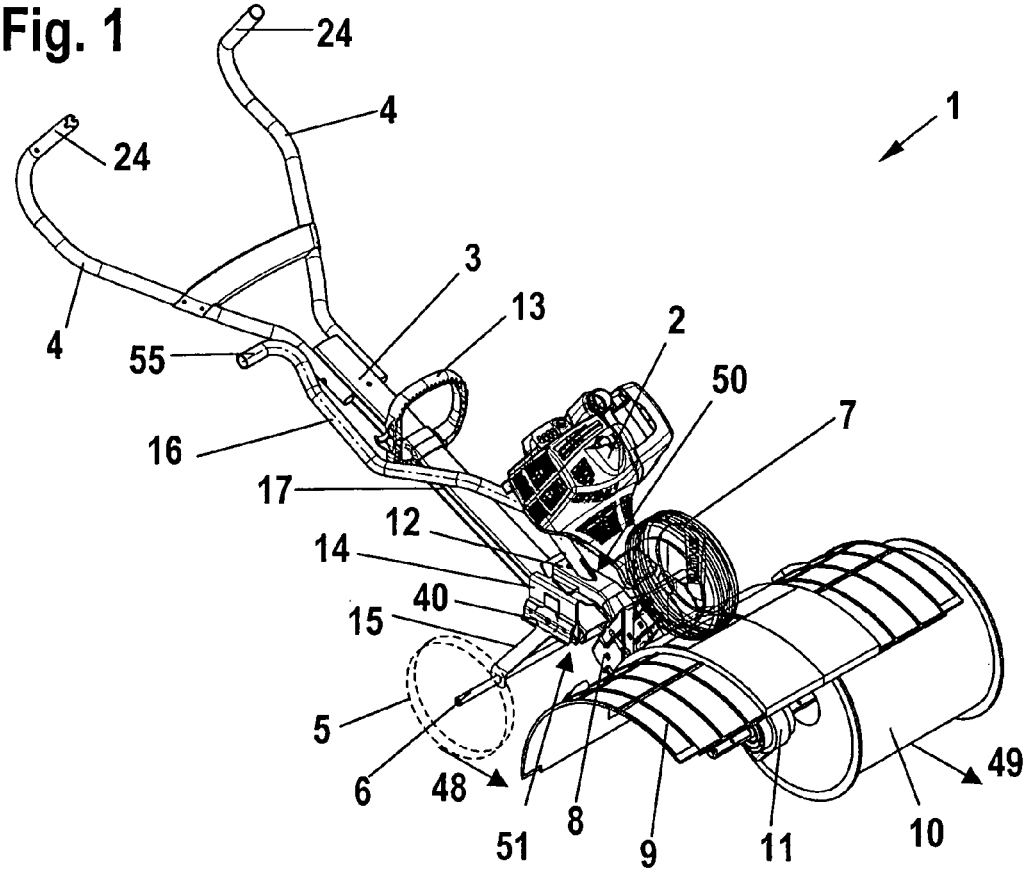
FIG. 1 is a perspective view of the sweeper according to the invention.

The sweeper 1 shown in FIG. 1 has a drive motor 2 such as a two-stroke engine which drives two sweeper brushes 10 in rotation via a flexible shaft (not shown) and a gear assembly 11. In FIG. 1, only one of the two sweeper brushes 10 is shown. The other sweeper brush 10 is arranged mirror symmetrically on the other side of the gear assembly 11. The two sweeper brushes 10 are partially surrounded by a protective cover 9. The drive motor 2 and the sweeper brushes 10 are fixed on a common mount 8. The mount 8 is attached to a mounting flange 12 at the bores 39 shown in FIG. 4. The mounting flange 12 is attached to a connecting flange 14 via a first adjusting device 50. A guide rod 3 is mounted on the connecting flange 14 via a second adjusting device 51. The adjusting devices 50 and 51 are fixed at a first end 53 of the guide rod 3 (FIG. 2).

The drive motor 2 is arranged above the adjusting devices (50, 51) and thereby lies in the travel direction behind the sweeper brushes 10. In this way, the center of gravity does not lie above the sweeper brushes 10. This reduces the force acting on the sweeper brushes 10 in the vertical direction which leads to an improved sweeping result. A carrier handle 13 is attached to the guide rod 3 for the simple transport of the sweeper 1.

The guide rod 3 (FIG. 2) has an end 52 lying opposite the first end 53. Two handle tubes 4 are mounted on the end 52 of the guide rod 3 so as to be symmetrical to a mirror plane including the center axis 54 of the guide rod 3. Each handle tube 4 has a handle 24 on which the sweeper 1 can be guided over the ground.

Figure 2:
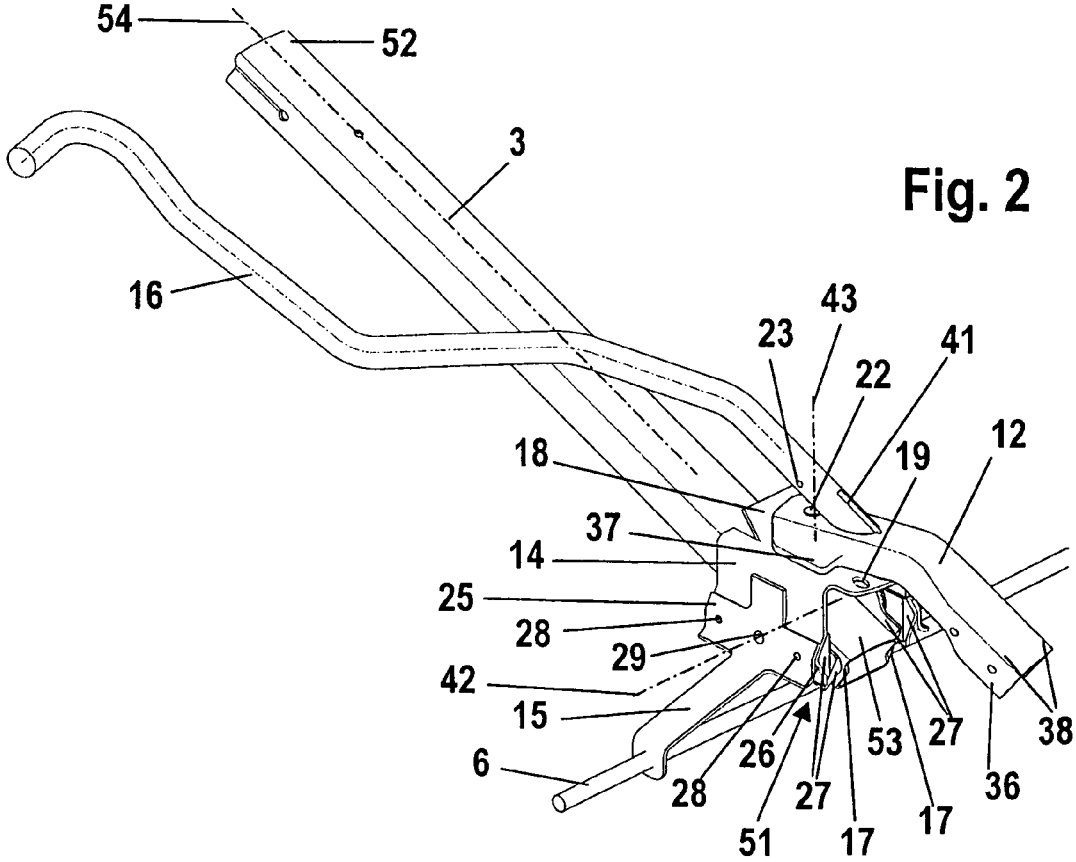
FIG. 2 is a perspective view of the adjusting devices of the sweeper of FIG. 1.

The connecting flange 14 is configured mirror symmetrically to the mirror plane including the center axis 54 of the guide rod 3 shown in FIG. 2. Two struts or outriggers 15 are fixed on the connecting flange 14 and one of these struts or outriggers is shown in FIG. 1. The other strut 15 extends on the opposite-lying side of the connecting flange 14 and is mirror symmetrical to the strut 15 shown. The two struts hold the axle 6 on which two wheels (5, 7) of the sweeper 1 are mounted. In FIG. 1, a wheel 5 is shown in phantom outline and the wheel 7 is shown in part. To actuate the second adjusting device 51, a hand wheel 40 is provided which is also indicated in FIG. 1 in phantom outline. The sweeper brushes 10 are driven in rotation opposite to the running direction 48 of the wheels 5. In FIG. 1, the running direction 48 of the wheels (5, 7) runs parallel to the running direction 49 of the sweeper brushes 10.

The sweeper 1 has an actuating tube 16 for actuating the first adjusting device 50. The actuating tube 16 extends from the mounting flange 12 to the second end 52 of the guide rod 3 at which the handle tubes 4 are also fixed. The actuating tube 16 is configured so as to be rolled out at its end 55 facing away from the mounting flange 12 so that the operator can easily grasp the actuating tube 16. The drive motor 2 is supported on the mounting flange 12.

In FIG. 2, the adjusting devices (50, 51) are shown enlarged. The first adjusting device includes a bolt 22 with which the mounting flange 12 is rotatably journalled about a vertical axis 43 on the connecting flange 14. The mounting flange 12 has a guide piece 41 onto which the actuating tube 16 is pushed. The guide piece 41 is configured as a strut which extends on the outer side of a stub 33 (shown in FIG. 3) in the longitudinal direction of the stub 33. The mounting flange 12 has the form of an angled member having a U-shaped profile. In order to ensure an adequate stability, the mounting flange 12 has ribs 37, which lie on the upper side of the connecting flange 14 on both sides of the mounting flange 12, and also has thickenings 38 on the end which faces toward the mount 8 (FIG. 1). The thickenings 38 extend on the base of the U-shaped profile outwardly. At this end, ribs 36 are provided for stiffening and define extensions of the legs of the U-shaped profile. The first adjusting device 50 has the opening 19 (shown in FIG. 2) which is configured as an elongated opening.

Figure 4:
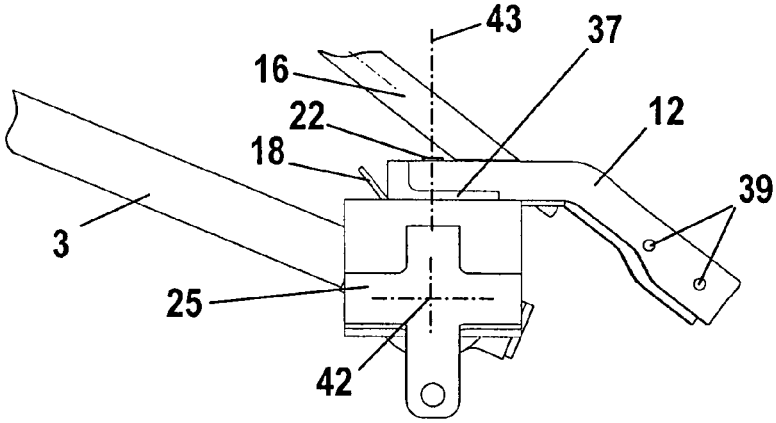
FIG. 4 is a side elevation view of the adjusting devices.

The second adjusting device 51 permits an adjustment of the guide rod 3 about the horizontal axis 42 (see FIG. 4). The guide rod 3 has a V-shaped longitudinal slot 17 on its longitudinal sides. A toothed element 27 is mounted in each of the longitudinal slots 17. The connecting flange 14 has respective V-shaped profiles 26 opposite corresponding ones of the longitudinal slots 17. Respective toothed elements 27 are mounted in the longitudinal slots 17 and the V-shaped profiles 26. Each two toothed elements 27 thereby form a toothed pair.

Figure 5:
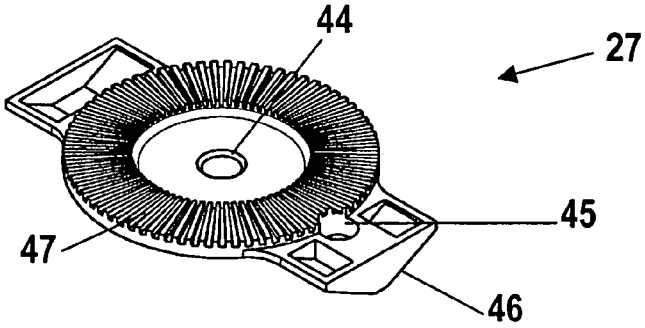
FIG. 5 is a perspective view of a toothed element.

A toothed element 27 is shown perspectively enlarged in FIG. 5. The toothed element 27 has a set of teeth 47 at its side. A tightening or clamping bore 44 is arranged at the center of the set of teeth 47. On the side, which faces away from the set of teeth 47, the toothed element 27 has a V-profile 46 formed as an elevation. This V-shaped profile 46 corresponds to the V-shaped profile 26 of the connecting flange 14 and the longitudinal slot 17 in the guide rod 3. Attachment openings 45 are arranged on both sides of the set of teeth 47.

As FIG. 2 shows, the connecting flange 14 and the attachment section 25 of the strut 15 have a clamping bore 29. The attachment section 25 is arranged on the connecting flange 14 and the clamping bore 29 is arranged concentrically to the clamping bore 44 of the toothed elements 27. Attachment bores 28 are arranged concentrically to the attachment openings 45 of the toothed elements 27. The attachment bores 28 are on both sides of the clamping bore 29. The toothed element 27 is arranged in the V-profile 26 of the connecting flange 14 and is connected to the connecting flange 14 and the attachment section 25 of the strut 15 at the attachment bores 28. The opposite-lying toothed element 27 is fixedly connected to the guide rod 3 at its attachment openings 45. A bolt of the hand wheel 40 extends through the clamping bore 29 and the clamping bores 44 of both toothed elements 27. With the hand wheel 40, the two toothed elements 27 can be clamped against each other.

The connecting flange 14 is pretensioned outwardly so that it bends outwardly after loosening the hand wheel 40 and the two toothed elements 27 can be rotated relative to each other. A stop 18 is provided on the mounting flange 12 and this stop limits the adjustment of the guide rod 3 upwardly. The set of teeth 47 of the toothed elements 27 can, for example, include 72 teeth so that adjustment steps of 5° are possible.

Figure 3:
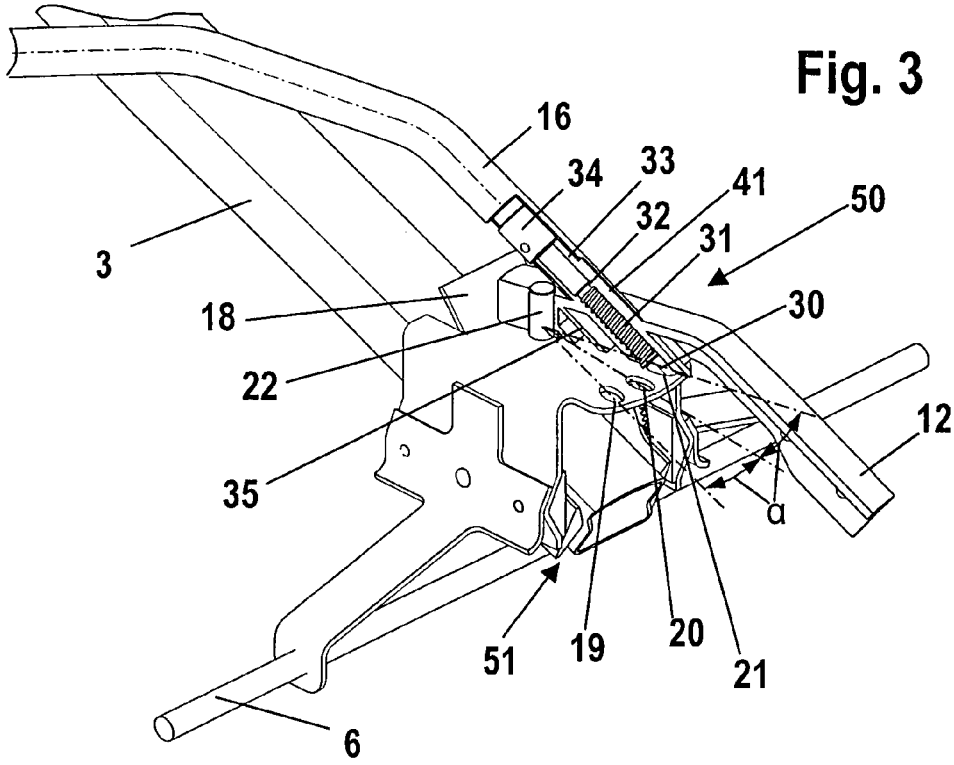
FIG. 3 is an enlarged perspective view, partially in section, of the adjusting devices of FIG. 2.

In FIG. 3, the first adjusting device 50 is shown partially in section. The first adjusting device 50 has three openings (19, 20, 21) which are configured as respective longitudinal holes. The longitudinal direction of the openings (19, 20, 21) extends radially to the bolt 22. Each two mutually adjacent openings conjointly define an angle a with each other referred to the vertical axis 43 running through the bolt 22. The angle a is preferably between 10° to 20°, especially approximately 15°. In the position of the first adjusting device 50 shown in FIG. 3, a pin 30 is disposed in the opening 21. The pin 30 is held in a receptacle 34. The receptacle 34 is connected to the actuating tube 16 via a transverse bore 23 shown in FIG. 2. The pin 30 is surrounded by a spring 31 which is braced with one end on the pin 30 and, at the other end, on a shoulder 32 in the stub 33 of the mounting flange 12. The actuating tube 16 is pushed over the stub 33 of the mounting flange 12 and is guided on the guide 41 which is configured as one piece with the stub 33.

For stiffening, the mounting flange 12 has ribs 35 which extend between the two legs of the mounting flange 12. In order to achieve an adequate strength of the mounting flange 12, the mounting flange contains magnesium and/or is made of magnesium. The connecting flange 14 also advantageously contains magnesium or is made completely of magnesium. The actuating tube 16 is pulled in the direction toward the handle tubes 4 for actuating the first adjusting device 50. In this way, the pin 30 is pulled out of the opening 21. The actuating tube 16 together with the sweeper brushes, which are arranged on the mounting flange 12, and the drive motor can then be rotated about the vertical axis 43 (shown in FIG. 4) relative to the guide rod 3 and the wheels (5, 7) of the sweeper 1. For fixing in another position, the pin 30 is brought over the opening 19 or the opening 20 and the actuating tube 16 is released so that the pin 30 is pressed into the opening 19 or 20 by the spring 31. Other openings can be provided in order to offer more adjusting possibilities.

It is understood that the foregoing description is that of the preferred embodiments of the invention and that various changes and modifications may be made thereto without departing from the spirit and scope of the invention as defined in the appended claims.

What is claimed is:

1. A hand-guided sweeper comprising:

a guide rod;

at least one handle attached to said guide rod for guiding the sweeper over the ground;

at least one sweeper brush;

a drive motor for driving said sweeper brush in rotation;

at least one wheel and said at least one wheel and said sweeper brush being in contact engagement with the ground during operation of said sweeper;

a first adjusting device for positionally adjusting said guide rod relative to said sweeper brush about an axis vertical with respect to the ground;

a second adjusting device for positionally adjusting said guide rod relative to said sweeper brush and said wheel about an axis horizontally referred to the ground;

said first adjusting device including first and second openings and a pin for engaging said first opening in a first position of said first adjusting device and for engaging said second opening in a second position of said first adjusting device; and, said first adjusting device further including a spring for holding said pin in said first or second opening.

2. The hand-guided sweeper of claim 1, further comprising a connecting flange; and, said first and second adjusting devices being mounted on said connecting flange with said connecting flange being common to both of said adjusting devices.

3. The hand-guided sweeper of claim 2, wherein said first adjusting device further includes a mounting flange attached to said connecting flange so as to be rotatable thereon about said vertical axis; and, said actuating element is attached to said mounting flange.

4. The hand-guided sweeper of claim 3, further comprising a mount common to both said drive motor and said sweeper brush; and, said drive motor, said sweeper brush and said mounting flange all being mounted on said mount.

5. The hand-guided sweeper of claim 3, wherein at least one of said mounting flange and said connecting flange contains magnesium.

6. The hand-guided sweeper of claim 1, wherein said first adjusting device includes a third opening; said three openings being arranged so as to permit said sweeper brush to be arranged to assume a position parallel to the running direction of said at least one wheel and a position rotated by 15° in both directions relative to said running direction of said at least one wheel.

7. The hand-guided sweeper of claim 1, wherein said guide rod has a first end facing toward said sweeper brush; and, said first adjusting device is mounted on said first end of said guide rod.

8. The hand-guided sweeper of claim 7, wherein said guide rod has a second end facing away from said sweeper brush; and, said first adjusting device includes an actuating element which extends up to said second end of said guide rod.

9. The hand-guided sweeper of claim 8, wherein said actuating element is configured as an actuating tube connected to said pin.

10. A hand-guided sweeper comprising:

a guide rod;

at least one handle attached to said guide rod for guiding the sweeper over the ground;

at least one sweeper brush;

a drive motor for driving said sweeper brush in rotation;

at least one wheel and said at least one wheel and said sweeper brush being in contact engagement with the ground during operation of said sweeper;

a first adjusting device for positionally adjusting said guide rod relative to said sweeper brush about an axis vertical with respect to the ground;

a second adjusting device for positionally adjusting said guide rod relative to said sweeper brush and said wheel about an axis horizontally referred to the ground; and, said second adjusting device including first and second toothed elements which are in mutual engagement.

11. The hand-guided sweeper of claim 10, further comprising a connecting flange; and, said first toothed element being connected to said connecting flange so as to not rotate relative thereto and said second toothed element being connected to said guide rod so as to not rotate relative thereto.

12. The hand-guided sweeper of claim 11, said second adjusting device further including means for releasably clamping said first and second toothed elements against each other.

13. The hand-guided sweeper of claim 12, said connecting flange being so pretensioned that said first and second toothed elements can be rotated relative to each other when said clamping means is loosened.

14. The hand-guided sweeper of claim 11, wherein said guide rod defines a center axis and said second adjusting device is configured so as to be mirror symmetrical with respect to said center axis; and, wherein said first and second toothed elements define a first pair of toothed elements and said second adjusting device includes a second pair of said toothed elements; and, said first and second pairs of toothed elements are disposed on respective sides of said guide rod.

* * * * *